US010738789B2

(12) United States Patent
Ragni et al.

(10) Patent No.: US 10,738,789 B2
(45) Date of Patent: Aug. 11, 2020

(54) METHOD OF MONITORING THE STATUS OF A TURBOMACHINE HAVING A CASING WHEREIN LIQUID MAY ACCUMULATE, ARRANGEMENT AND TURBOMACHINE

(71) Applicant: Nuovo Pignone Srl, Florence (IT)

(72) Inventors: Giacomo Ragni, Florence (IT); Francesco Bongini, Florence (IT); Manuele Bigi, Florence (IT); Paolo Trallori, Florence (IT); Massimiliano Ortiz Neri, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 447 days.

(21) Appl. No.: 15/516,633

(22) PCT Filed: Oct. 2, 2015

(86) PCT No.: PCT/EP2015/072872
§ 371 (c)(1),
(2) Date: Apr. 3, 2017

(87) PCT Pub. No.: WO2016/050978
PCT Pub. Date: Apr. 7, 2016

(65) Prior Publication Data

US 2018/0231012 A1 Aug. 16, 2018

(30) Foreign Application Priority Data

Oct. 3, 2014 (IT) ..... MI2014A1735

(51) Int. Cl.
*F04D 27/00* (2006.01)
*F04D 25/06* (2006.01)
*F01D 25/32* (2006.01)

(52) U.S. Cl.
CPC ..... *F04D 27/001* (2013.01); *F01D 25/32* (2013.01); *F04D 25/0686* (2013.01); *F05D 2260/602* (2013.01); *F05D 2260/84* (2013.01)

(58) Field of Classification Search
CPC ..... F04D 27/001; F04D 25/0686; F01D 25/32
See application file for complete search history.

(56) References Cited

U.S. PATENT DOCUMENTS 2,388,975 A * 11/1945 Jefferson ..... F01D 25/32 415/169.2
4,969,803 A * 11/1990 Turanskyj ..... F04D 17/122 415/177

(Continued)

FOREIGN PATENT DOCUMENTS

CN 102348899 A 2/2012
EP 2 799 716 A2 11/2014

OTHER PUBLICATIONS

Italian Search Report and Written Opinion issued in connection with corresponding IT Application No. MI2014A001735 dated May 19, 2015.

(Continued)

*Primary Examiner* — Woody A Lee, Jr.
(74) *Attorney, Agent, or Firm* — Baker Hughes Patent Org.

(57) ABSTRACT

A turbomachine has a casing where liquid may accumulate; at least one liquid level detector is located inside the casing for automatically detecting liquid accumulated inside the casing during operation of the turbomachine; the liquid level detector may be arranged for detecting one or two or three or four liquid levels inside the casing; the liquid level detector is typically connected to an electronic unit at least for automatically signaling the liquid level. The electronic unit controls at least one valve for automatically discharging (Continued)

the accumulated liquid from the casing; in this way, the status of the turbomachine is not only monitored but also managed.

10 Claims, 3 Drawing Sheets

(56) References Cited

U.S. PATENT DOCUMENTS

| | | | | |
|---|---|---|---|---|
| 2007/0029091 | A1* | 2/2007 | Stinessen | E21B 43/36 166/357 |
| 2011/0203460 | A1* | 8/2011 | Skofteland | E21B 43/36 96/408 |
| 2012/0055335 | A1* | 3/2012 | Mateman | F04D 13/12 95/153 |
| 2012/0103188 | A1* | 5/2012 | Stinessen | E21B 43/34 95/24 |
| 2013/0128031 | A1 | 5/2013 | Singh | |
| 2013/0199792 | A1* | 8/2013 | Backes | E21B 43/0122 166/335 |
| 2014/0223894 | A1* | 8/2014 | Tomter | E21B 43/36 60/327 |

OTHER PUBLICATIONS

International Search Report and Written Opinion issued in connection with corresponding PCT Application No. PCT/EP2015/072872 dated Dec. 10, 2015.

First Office Action and Search issued in connection with corresponding CN Application No. 201580053632.7 dated Mar. 15, 2018.

* cited by examiner

METHOD OF MONITORING THE STATUS OF A TURBOMACHINE HAVING A CASING WHEREIN LIQUID MAY ACCUMULATE, ARRANGEMENT AND TURBOMACHINE

BACKGROUND

Embodiments of the subject matter disclosed herein relate to method of (at least) monitoring the status of a turbomachine having a casing wherein liquid may accumulate, as well as corresponding arrangements and turbomachines.

There are "oil & gas" equipments, including one or more turbomachines, designed to receive an input working fluid that is made of gas material. Some of them are designed to receive an input working fluid that contains always a small quantity of liquid material in addition to the gas material. Some of them are designed to receive an input working fluid that contains occasionally a small quantity of liquid material in addition to the gas material.

When some liquid material is always present in the fluid to be provided to the inlet of the equipment, it is common practice to provide a separator before the inlet of the turbomachine so that to reduce or remove the liquid. In this case, the average percentage of input liquid is relatively high.

When some liquid material is occasionally present in the fluid to be provided to the inlet of the equipment (for example during washing procedures or slugs), it is common practice to design the parts of the turbomachine so that they are able to resist the collisions of the liquid droplets. In this case, the average percentage of input liquid is quite low.

Evidently, it is possible use both solutions mentioned above in the same equipment.

SUMMARY

Managing liquid in the "main flow" of the turbomachines due to the possible damages caused by it to the stationary and rotary parts of the machine in contact with the working fluid; by using a separator liquid in the "main flow" is avoided or reduced, and liquid in any "secondary flow" is also avoided or reduced.

According to the common practice, if some liquid accumulates inside the casing of the turbomachine during operation due to any "secondary flow" (or any other cause), it is removed during maintenance operations, i.e. "off-line" when the turbomachine is not productive, by opening the casing. If an operator has the feeling that too much liquid might be accumulated, He may decide to carry out an extra maintenance operation in addition to the ordinary planned maintenance operations.

The present inventors have thought that such solution to the problem of accumulation of liquid (essentially due to any "secondary flow") requires improvement.

This particularly true for turbomachines designed to be located underwater, i.e. for "subsea" operation; in fact, in this case, access to the machine is extremely difficult and maintenance is particularly difficult and extra maintenance operation is generally avoided. For these applications, designers include one or more very good separators in the subsea equipments before the inlet of the turbomachine.

The present inventors have also thought of providing in an embodiment special draining conduits starting from the plenum at the inlet of the turbomachine (for example a centrifugal compressor) and leading to a sump of the turbomachine; such conduits create a "wanted" secondary flow of liquid, in additional to the inevitable one. In this case, drainage of the liquid e.g. in the sump may be necessary.

First exemplary embodiments relate to methods of monitoring the status of a turbomachine having a casing wherein liquid may accumulate.

In general, according to an embodiment of the method, at least one liquid level detector is located inside the casing for automatically detecting liquid accumulated inside the casing during operation of the turbomachine.

It is to be noted that, according to some of the first exemplary embodiments, the status of the turbomachine is not only monitored but also managed.

Additional exemplary embodiments relate to arrangements for monitoring the status of a turbomachine having a casing wherein liquid may accumulate.

In general, an embodiment of the arrangement comprising mechanic, hydraulic, electric, electronic devices for carrying out the method as set out above in general or as described in detail in the following.

It is to be noted that, according to some of the second exemplary embodiments, the status of the turbomachine is not only monitored but also managed.

Some exemplary embodiments relate to turbomachines.

In general, an embodiment of the turbomachine comprising mechanic, hydraulic, electric, electronic devices for carrying out the method as set out above in general or as described in detail in the following.

BRIEF DESCRIPTION OF DRAWINGS

Embodiments of the present invention will become more apparent from the following description of exemplary embodiments to be considered in conjunction with accompanying drawings wherein.

DETAILED DESCRIPTION

The following description of exemplary embodiments refer to the accompanying drawings. The same reference numbers in different drawings identify the same or similar elements. The following detailed description does not limit the invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
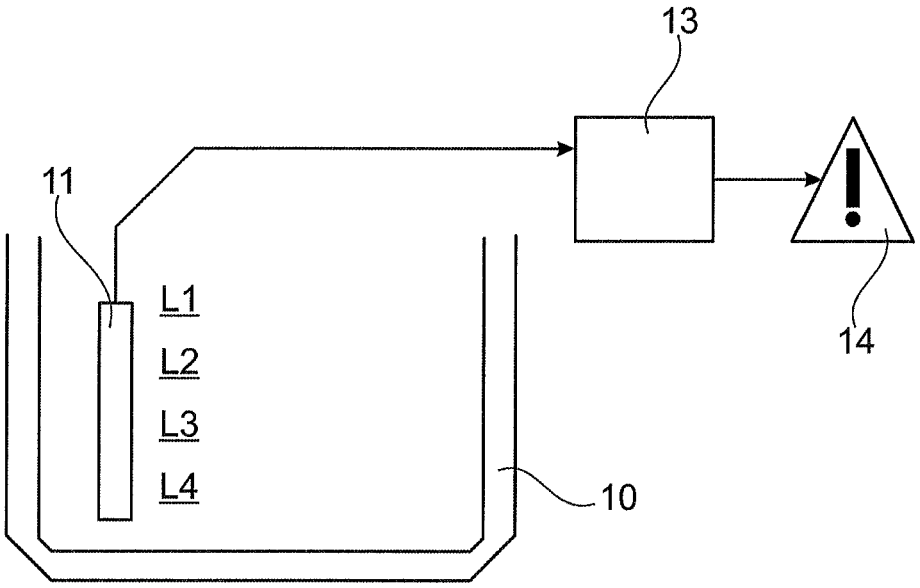
FIG. 1 shows a simplified block diagram of a first embodiment of an arrangement according to embodiments of the present invention.

FIG. 1 shows an arrangement comprising: a liquid level detector 11 adapted to detect four different liquid levels L1, L2, L3, L4, an electronic unit 13 connected to the liquid level detector 11 and receiving electric signals generated by the liquid level detector 11 and corresponding to the detected liquid level, a signaling unit 14 connected to the electronic unit 13 and adapted to generate (for example visual and/or acoustic) signaling corresponding to electric signals received from the electronic unit 13.

The liquid level detector 11 is located inside a casing 10 of a turbomachine, in particular in a sump, where liquid may accumulate during operation of the turbomachine—only the sump of the turbomachine is shown in FIG. 1; the liquid level detector 11 consists of a single detecting device.

Figure 2:
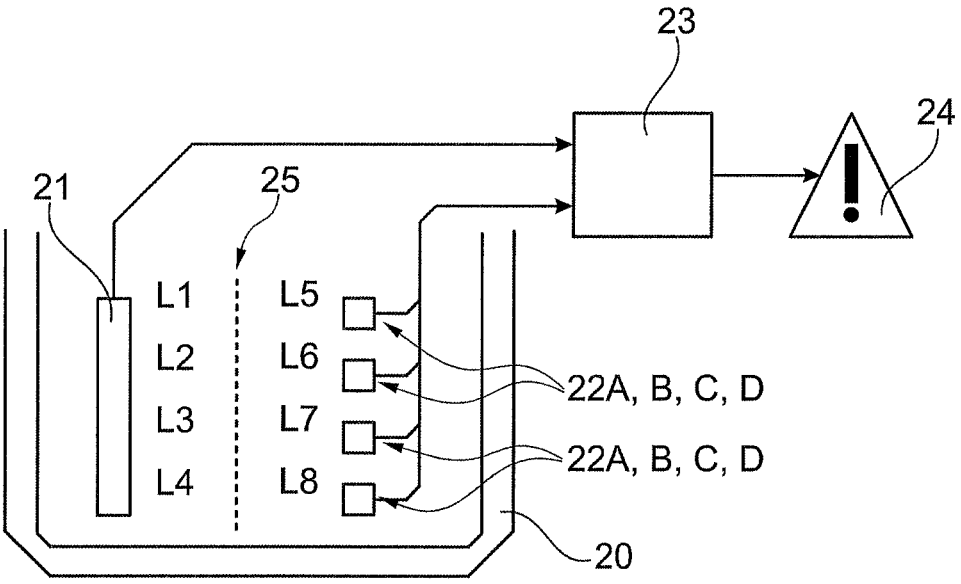
FIG. 2 shows a simplified block diagram of a second embodiment of an arrangement according to embodiments of the present invention.

FIG. 2 shows an embodiment of an arrangement.

It is similar to the one in FIG. 1; it comprises further another liquid level detector 22 adapted to detect four different liquid levels L5, L6, L7, L8; the electronic unit 23 is connected to the liquid level detector 22 and receives electric signals generated by the liquid level detector 22 and corresponding to the detected liquid level. The liquid level detector 22 consists of four detecting devices 22A, 22B, 22C, 22D; each of them is dedicated to detect a different liquid level; the detecting device 22A detects liquid level L5, the detecting device 22B detects liquid level L6, the detecting device 22C detects liquid level L7, the detecting device 22D detects liquid level L8.

In the embodiment of FIG. 2, there is a vertical dotted line 25 meaning that the first liquid level detector 21 may detect liquid level in a first zone of the sump 20 and the second liquid level detector 22 may detect liquid level in a second zone of the sump 20.

Figure 3:
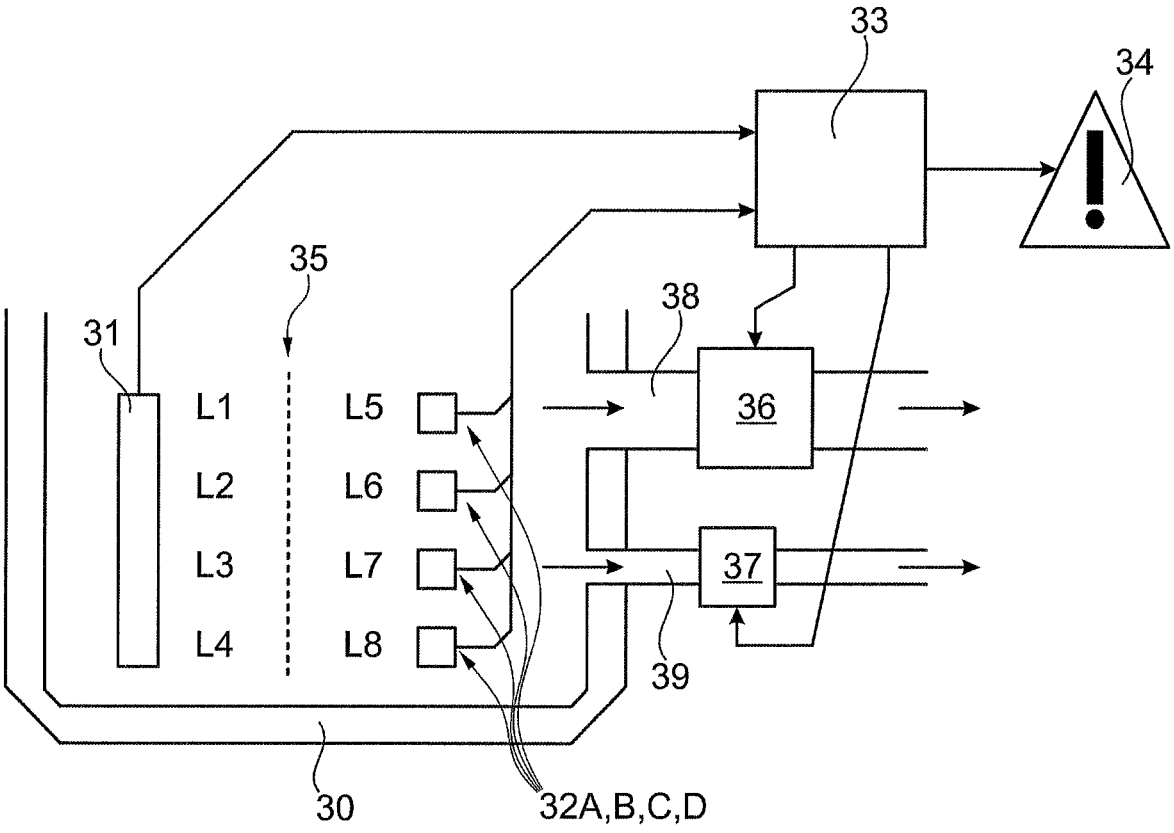
FIG. 3 shows a simplified block diagram of a third embodiment of an arrangement according to embodiments of the present invention.

FIG. 3 shows an embodiment of an arrangement.

It is similar to the one in FIG. 2 it comprises further a first draining valve 36 and a second draining valve 37; the first draining valve 36 is fluidly connected to a first draining conduit 38 starting from the sump 30 at a first height from the bottom of the sump 30; the second draining valve 37 is fluidly connected to a second draining conduit 39 starting from the sump 30 at a second height from the bottom of the sump 30; the first height is higher than the second height; the cross-section of the first (higher) draining conduit 38 is much wider than the cross-section of the second (lower) draining conduit 39.

In the embodiment of FIG. 3, there is a vertical dotted line 35 meaning that the first liquid level detector 31 may detect liquid level in a first zone of the sump 30 and the second liquid level detector 32 may detect liquid level in a second zone of the sump 30.

As already said, according to embodiments of the present invention, the status of a turbomachine is monitored by automatically detecting liquid accumulated inside the casing during its operation; for this purpose, at least one liquid level detector is used; in the embodiment of FIG. 1, there is one liquid level detector 11; in the embodiment of FIG. 2, there are two liquid level detectors 21 and 22; in the embodiment of FIG. 3, there are two liquid level detectors 31 and 32.

In an embodiment, a liquid level detector is arranged for detecting one or two or three or four liquid (different) levels inside the casing. In all the embodiments of the figures, four liquid levels are provided: levels L4 and L8 correspond to "PRESENCE", levels L3 and L7 correspond to "LOW", levels L2 and L6 correspond to "HIGH", levels L1 and L5 correspond to "EMERGENCY".

In the embodiment of FIG. 1, there is only one liquid level detector.

In the embodiments of FIG. 2 and FIG. 3, there are two liquid level detectors; in particular, they are arranged to detect the same (or almost the same) levels, i.e. level L1 corresponds to level L5, level L2 corresponds to level L6, level L3 corresponds to level L7, level L4 corresponds to level L8.

In an embodiment, the first level detector, i.e. detector 21 or 31, operates according to a first principle and the second level detector, i.e. detector 22 or 32, operates according to a second principle; the second principle is different from the first principle; in this way, liquid level detection is very reliable. The first liquid level detector, i.e. detector 11 or 21 or 31, may be of the ultrasound type. The second liquid level detector, i.e. detector 22 or 33, may be for example of the optical type or induction type.

When two liquid level detectors are present, a first one may be used for a control system of the turbomachine (i.e. during "normal" operation) and a second one may be used for a protection system of the turbomachine (i.e. during "abnormal" operation).

In the embodiments of FIG. 1 and FIG. 2, the arrangement is able only to signal the liquid level inside the casing of the turbomachine; signaling may be done to a local operator and/or to a remote operator; signaling may be done for example to a local and/or remote computer or computerized system; signaling may be different in relation to the detected liquid level ("PRESENCE", "LOW", "HIGH", "EMERGENCY").

In addition to signaling, an arrangement according to embodiments of the present invention may be adapted to automatically discharge liquid from the casing of the turbomachine.

The embodiment of FIG. 3 is of this type.

In this embodiment, the liquid level detectors 31 and 32 are used for controlling drain valves 36 and 37 via an electronic unit 33; in general, only one detector may be present and only one valve may be present.

If two liquid level detectors electrically connected to the electronic unit are used, the first one may act as a main detector and the second one as a reserve detector.

If two drain valves electrically connected to the electronic unit are used, the first one may act as a main valve and the second one as a reserve valve.

In the embodiment of FIG. 3, for example, the two detectors are used in order to increase detection reliability.

In the embodiment of FIG. 3, for example, the two valves are used differently; valve 37 when the detected liquid level is e.g. "HIGH" and valve 37 when the detected liquid level is e.g. "EMERGENCY".

Figure 4:
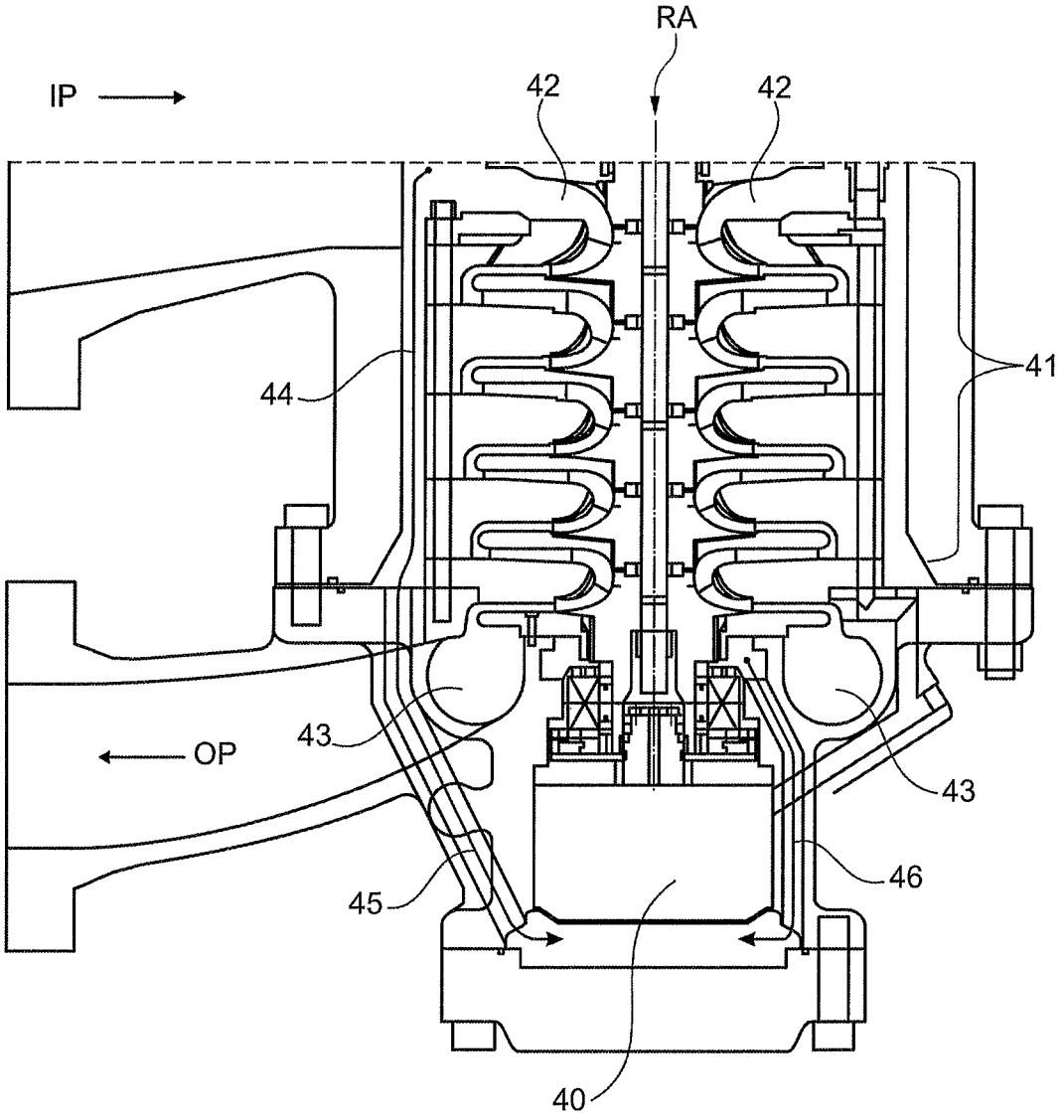
FIG. 4 shows a partial cross-sectional view of an embodiment of a turbomachine according to embodiments of the present invention.

FIG. 4 shows a partial cross-sectional view of an embodiment of a turbomachine according to embodiments of the present invention; this turbomachine comprises rotary centrifugal compressor 41 driven by an electric motor (not shown in the figure); this turbomachine is particularly designed to be installed underwater and used for compressing natural gas extracted from subsea gas fields; the rotation axis RA of the compressor and the motor is vertical; a sump 40 is located at the bottom for collecting liquid.

During operation of the compressor 41, some liquid may be present at the inlet 42 of the compressor coming from the inlet pipe IP; this liquid may be due to three main causes: formation of water coming from the well, hydrocarbon condensation due to the thermodynamic state and gas composition at the inlet, injection of MEG (Mono Ethylene Glycol) into the pipes to avoid unwanted chemical reactions.

During operation of the compressor 41, some liquid may be present at the outlet 43 of the compressor coming from the "main flow" and not evaporated along the way from the inlet to the outlet of the turbomachine; in general, this is not a problem as the outlet and its pipes are "wet tolerant".

During operation of the compressor 41, some liquid may be present in other cavities of the compressor close to the outlet 43, for example, a compensation chamber of a thrust balancing system.

The compressor 41 is designed so that liquid (at least some of it) at the inlet 42 and/or at a chamber close to the outlet 43 is directed toward the sump 40. For this purpose, special draining conduits 44 and 45 are provided starting from the plenum at the inlet 42 of the turbomachine and leading to the sump 40 of the turbomachine; other conduits 46 may be provided starting from a chamber close to the plenum at the outlet 43 of the turbomachine and leading to the sump 40 of the turbomachine. In this way, liquid in the "main flow" of the compressor is highly reduced; furthermore, liquid in the output pipe OP is also highly reduced. The liquid in the sump 40 is due to "wanted" "secondary flows".

If an arrangement according to embodiments of the present invention is associated to the turbomachine of FIG. 4, the liquid accumulated in the sump 40 is automatically signaled and may be automatically drained away from the sump 40 during operation of the turbomachine, i.e. without stopping it.

It is to be noted that FIG. 4 does not show any liquid level detector and any draining conduit and any drain valve; in any case, as it is apparent, the arrangement schematically shown in FIG. 1 or FIG. 2 or FIG. 3 fits with the bottom part of the turbomachine of FIG. 4.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Aspects from the various embodiments described, as well as other known equivalents for each such aspects, can be mixed and matched by one of ordinary skill in the art to construct additional embodiments and techniques in accordance with principles of this application.

What is claimed is:

1. A turbomachine configured to receive a primarily gaseous input working fluid having a detectable amount of a liquid, the turbomachine comprising:

a sump configured to collect liquid accumulated during operation of the turbomachine;

at least one drain valve arranged and configured to discharge liquid from the sump;

two liquid level detectors comprising a main detector and a reserve detector, said liquid level detectors configured to automatically detect liquid inside the sump during operation of the turbomachine and output an electrical signal corresponding to a level of the liquid in the sump to control, via an electronic unit, the at least one drain valve to automatically discharge said liquid from the sump, the electronic unit electrically connected to the two liquid level detectors and to the at least one drain valve and configured to receive the electrical signals outputted by said liquid level detectors; and a signaling unit connected to the electronic unit and configured to generate a signaling corresponding to electrical signals received from the electronic unit.

2. The turbomachine according to claim 1, comprising two drain valves electrically connected to the electronic unit, one of the two drain valves being a main valve and the other of the two drain valves being a reserve valve.

3. The turbomachine according to claim 1, wherein at least one of the liquid level detectors is an ultrasound detector.

4. The turbomachine according to claim 1, wherein the turbomachine further comprises a subsea compressor.

5. The turbomachine according to claim 1, wherein the liquid level detectors are configured to detect one or more liquid levels inside the sump.

6. The turbomachine according to claim 1, wherein the signaling is a visual and/or acoustic signaling.

7. The turbomachine according to claim 1, wherein one of the liquid level detectors operates according to a first detection principle and another of the liquid level detectors operates according to a second detection principle, wherein the second detection principle is different from the first detection principle.

8. The turbomachine according to claim 1, wherein the levels detected by one of the liquid level detectors correspond to the levels detected by another of the liquid level detectors.

9. The turbomachine according to claim 1, wherein one of the liquid level detectors is used for a control system of the turbomachine and another of the liquid level detectors is used as a protection system of the turbomachine.

10. The turbomachine according to claim 1, wherein the two liquid level detectors are both used for a control system and for a protection system of the turbomachine.

* * * * *